US010577766B2

(12) United States Patent
Isele

(10) Patent No.: US 10,577,766 B2
(45) Date of Patent: Mar. 3, 2020

(54) METHOD FOR FILLING AND EMPTYING A LIQUID TANK OF A SPREADER DEVICE FOR WINTER SERVICE VEHICLES, AND SPREADER DEVICE

(75) Inventor: Rolf Isele, Engen (DE)

(73) Assignee: KÜPPER-WEISSER GMBH, Bräunlingen (DE)

( * ) Notice: Subject to any disclaimer, the term of this patent is extended or adjusted under 35 U.S.C. 154(b) by 236 days.

(21) Appl. No.: 14/367,335

(22) PCT Filed: Jul. 6, 2012

(86) PCT No.: PCT/EP2012/063237

§ 371 (c)(1),
(2), (4) Date: Jul. 10, 2014

(87) PCT Pub. No.: WO2014/005648

PCT Pub. Date: Jan. 9, 2014

(65) Prior Publication Data

US 2015/0129689 A1 May 14, 2015

(51) Int. Cl.

| | |
|---|---|
| ***E01H 10/00*** | (2006.01) |
| ***E01C 19/21*** | (2006.01) |
| ***B05B 7/24*** | (2006.01) |

(52) U.S. Cl.

CPC ..... *E01H 10/007* (2013.01); *B05B 7/2483* (2013.01); *E01C 19/21* (2013.01); *Y10T 137/0318* (2015.04)

(58) Field of Classification Search

CPC ..... E01H 5/00; E01H 3/02; E01H 10/007; B05B 7/2483; Y10T 137/0318; A01C 23/04; A01C 23/045; A01C 23/047

(Continued)

(56) References Cited

U.S. PATENT DOCUMENTS 2,481,813 A * 9/1949 Bede ..... B05B 9/002 118/302
3,640,461 A * 2/1972 Koll ..... A01M 7/00 239/10

(Continued)

FOREIGN PATENT DOCUMENTS

DE 4008630 A1 9/1991
DE 19624189 A1 * 1/1998

(Continued)

OTHER PUBLICATIONS

International Preliminary Report on Patentability and Written Opinion dated Jan. 6, 2015 from corresponding International Patent Application No. PCT/EP2012/063237; 11 pgs.

(Continued)

*Primary Examiner* — Steven J Ganey
*Assistant Examiner* — Steven M Cernoch
(74) *Attorney, Agent, or Firm* — Maier & Maier, PLLC

(57) ABSTRACT

In a spreader for winter service vehicles, brine is filled from a tank sack into additional tanks by purely hydrostatic effect substantially without the use of pumps, by the tank sack being so filled for example by excess pressure that the brine is urged through a liquid line where it forms a closed liquid column. The exit end of the liquid line lies below the entrance end of the liquid line so that, upon filling, the liquid from the tank sack automatically flows into the additional tanks due to hydrostatic forces. Upon emptying the liquid tank, the liquid also flows in a corresponding manner from the tank sack into the additional tanks, thereby completely emptying the tank sack.

15 Claims, 11 Drawing Sheets

(58) Field of Classification Search
USPC ..... 137/1; 239/650–689, 126
See application file for complete search history.

(56) References Cited

U.S. PATENT DOCUMENTS

| | | | | | |
|---|---|---|---|---|---|
| 3,918,604 | A * | 11/1975 | Kersten | B61D 5/00 | 105/243 |
| 4,583,318 | A * | 4/1986 | Richardson | A01M 21/043 | 118/204 |
| 5,186,396 | A * | 2/1993 | Wise | E01H 10/007 | 239/675 |
| 5,236,507 | A * | 8/1993 | Brown | B65B 55/20 | 118/302 |
| 5,332,312 | A * | 7/1994 | Evanson | B01F 3/08 | 366/136 |
| 5,361,711 | A * | 11/1994 | Beyerl | A01G 13/0287 | 111/127 |
| 5,501,403 | A * | 3/1996 | van Vooren | E01H 10/007 | 239/662 |
| 5,819,776 | A * | 10/1998 | Kephart | B01F 1/0022 | 137/1 |
| 5,927,617 | A * | 7/1999 | Musso, Jr. | B60P 1/36 | 239/657 |
| 6,451,270 | B1 * | 9/2002 | Killian | B01F 1/0022 | 137/1 |
| 7,201,333 | B2 * | 4/2007 | Yoshikawa | A01G 25/165 | 239/145 |
| 7,370,818 | B2 * | 5/2008 | Ward | E01H 10/007 | 239/146 |
| 10,138,609 | B2 * | 11/2018 | Boschung | B60P 1/40 | |
| 2006/0078412 | A1 * | 4/2006 | Hagemann | B60P 3/426 | 414/467 |
| 2007/0084946 | A1 * | 4/2007 | Neville | A01C 23/047 | 239/172 |
| 2011/0039961 | A1 * | 2/2011 | Matsumoto | A61L 15/60 | 521/63 |
| 2012/0087736 | A1 * | 4/2012 | Tikalsky | A01M 29/30 | 405/128.7 |
| 2013/0200007 | A1 * | 8/2013 | O'Konek | C02F 1/385 | 210/749 |
| 2015/0040628 | A1 * | 2/2015 | Parrish | C02F 1/281 | 71/22 |

FOREIGN PATENT DOCUMENTS

| | | | |
|---|---|---|---|
| DE | 102010029142 | A1 | 6/2011 |
| FR | 2667335 | A1 | 4/1992 |
| JP | 10-317348 | A | 12/1998 |
| JP | 2007-130621 | A | 5/2007 |
| SU | 1189375 | A1 * | 11/1985 |

OTHER PUBLICATIONS

International Search Report dated Apr. 24, 2013, as issued in corresponding International Patent Application No. PCT/EP2012/063237, filed Jul. 6, 2012; 2 pgs.

KR office action dated Nov. 3, 2015 from corresponding Patent Application No. 10-2014-7027298; 20 pgs.

* cited by examiner

METHOD FOR FILLING AND EMPTYING A LIQUID TANK OF A SPREADER DEVICE FOR WINTER SERVICE VEHICLES, AND SPREADER DEVICE

This invention relates to a method for filling and a method for emptying a liquid tank of a spreading material device for winter service vehicles, and to a spreader for winter service vehicles that is accordingly arranged for carrying out said methods, and to a winter service vehicle as such that is equipped with such a spreader.

Figure 17:
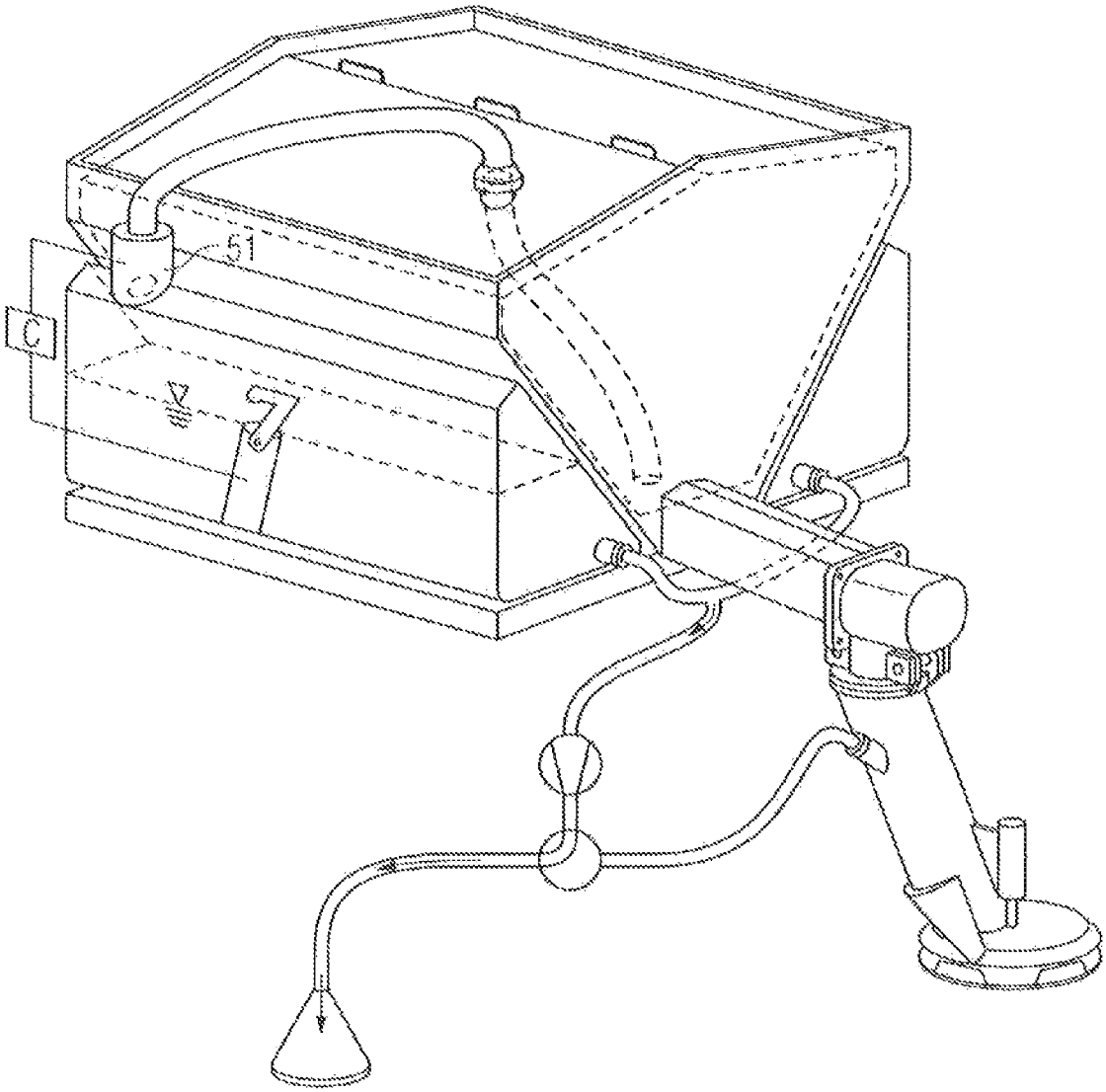
FIG 17 PRIOR ART
Figure 18:
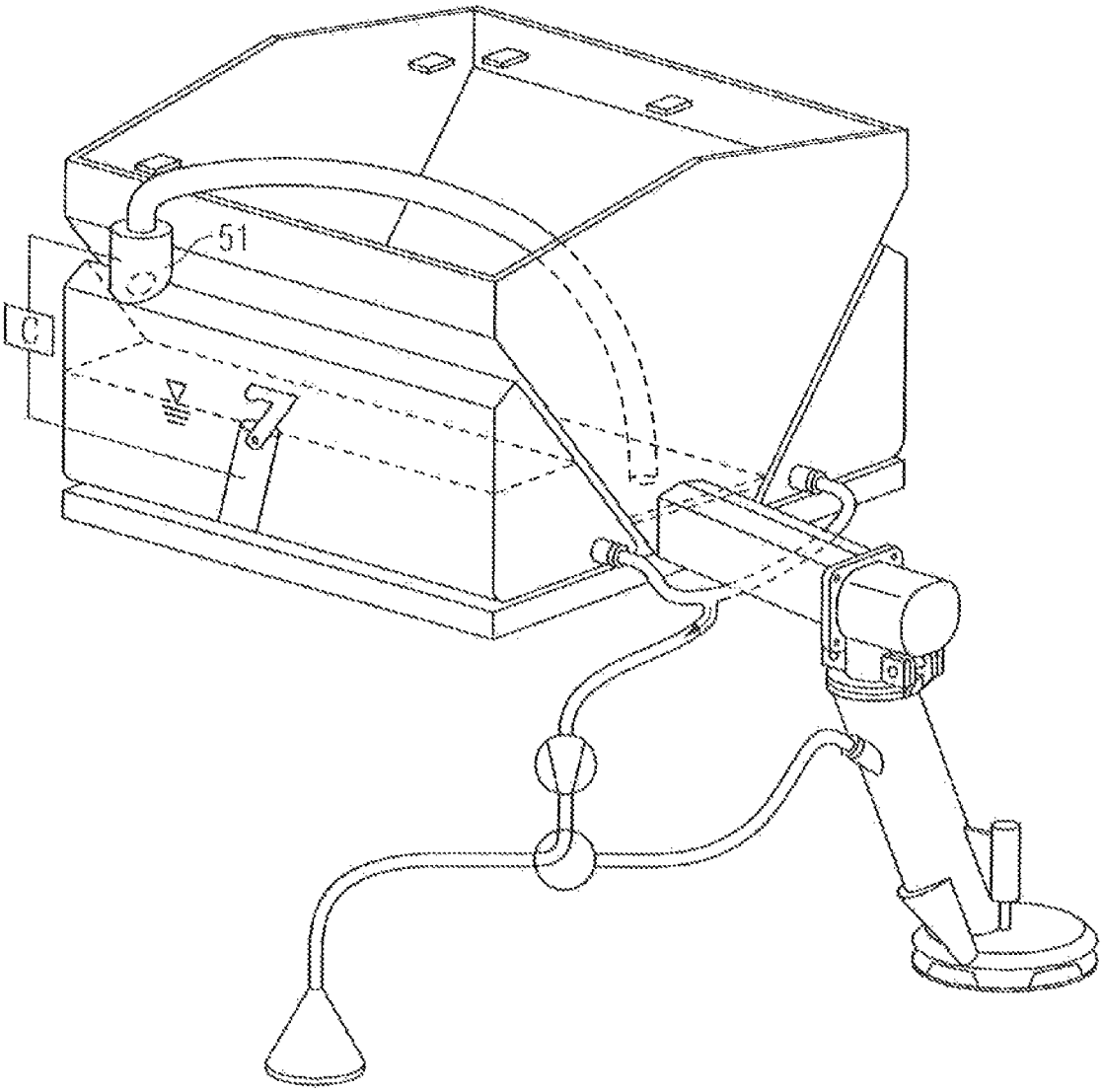
FIG 18 PRIOR ART

German laid-open application DE 10 2010 029 142 A1 discloses a spreader for winter service vehicles which combines three different spreading methods, namely dry salt spreading, wet salt spreading and pure brine spreading. Normally the brine for wet salt spreading and pure brine spreading is located in an additional tank which is mounted for example laterally of the spreading material container in which the spreading salt is kept. Since the additional tanks are too small for spreading pure brine over a standard spreading path of approx. 50 km, DE 10 2010 029 142 A1 proposes utilizing the spreading material container electively as a further tank container for receiving brine. The additional tanks are retained in case wet salt is to be spread and the spreading material container is required for receiving solid thawing materials. Instead of employing the spreading material container itself as a further tank container, there can alternatively be provided a tank sack insertable into the spreading material container. The brine required for pure brine spreading is conveyed out of the additional tanks in the conventional manner here, and the additional tanks are automatically refilled with brine from time to time from the spreading material container or the tank sack received therein. This is done using a pump which pumps into the additional tanks the brine received in the spreading material container or tank sack via a hose protruding thereinto. The pump used may be a suction pump 51, as represented in FIGS. 17 and 18, or alternatively a submerged pump.

The use of the pumps for automatically filling the additional tanks has turned out to be trouble-prone, however.

The object of the present invention is hence to overcome this disadvantage of the prior art.

This object is achieved by a method for filling and a method for emptying a liquid tank of a winter service spreader and by an accordingly adapted spreader having the features of the independent claims. Claims dependent thereon state advantageous developments and embodiments of the invention.

The core of the invention is to be seen in that the automatic refilling of the additional tanks with brine from the spreading material container or the tank sack inserted therein is obtained substantially solely through hydrostatic forces. By means of the solution according to the invention it is not only possible to refill the additional tanks during operation, however, but it is likewise possible to couple the first-time filling of the additional tanks with the filling of the spreading material container or the tank sack received therein such that this can be effected in one step. The different tank containers thus no longer need to be filled separately, which means a considerable facilitation and time saving.

Accordingly, the method according to the invention, for filling a liquid tank which comprises as a first tank container e.g. the spreading material container or the tank sack received therein and as one or more second tank containers e.g. the above-mentioned additional tanks, provides that the first tank container is connected to the second tank container or containers via a liquid line such that the first tank container is first filled with liquid, for example with brine, up to a moment as of when the liquid filled into the first tank container begins to flow through the liquid line into the at least one second tank container, with the filling of the second tank container or containers with liquid from the first tank container being effected through the liquid line following this moment.

This can now be effected in principle in two different ways. Either one attaches the liquid line in a lower region of the spreading material container to the latter or the tank sack received therein and connects it preferably leading constantly downward to the additional tank or tanks, so that the liquid begins to flow directly into the additional tanks upon filling of the main tank, i.e. the spreading material container or the tank sack received therein. When the height of the main tank overlaps with the height of the additional tank or tanks and the liquid level in the main tank rises, the liquid level also rises in the additional tanks until the latter are completely filled. Subsequently, the main tank can be filled further up to the maximum filling volume. Upon later emptying of the liquid tank through removal of the liquid from the additional tanks, the liquid level in the main tank first sinks until it has reached the highest level of the additional tanks, whereupon the liquid level in the main and additional tanks drops uniformly upon further emptying.

This first possibility of hydrostatically filling and emptying the liquid tank is relatively easy to realize when the spreading material container itself is utilized as the first tank container, i.e. as the main tank. For in this case the liquid line can be attached to the front sides of the main and additional tanks in a relatively simple manner. This is more problematic, however, when there serves as the first tank container or main tank e.g. a tank sack inserted in the spreading material container. For then the tank sack must be attached to the spreading material container walling or be guided therethrough in a lower region of the spreading material container. This lower region of the spreading material container is poorly accessible, however, in particular when a tank sack is located therein. Since the employment of a tank sack as a main tank is to be preferred to the use of the spreading material container itself, the second possibility for hydrostatically filling and emptying the liquid tank to be described hereinafter offers certain advantages.

According to this second possibility, the liquid line possesses a highest point between the two line openings at the respective ends of the liquid line. This highest point preferably lies at the height of an upper region of the first tank container (main tank) or thereabove, so that the step of filling the second tank container or containers (additional tanks) only begins when the first tank container is completely or at least almost completely filled. For the filling of the second tank container or containers only begins after the liquid in the liquid line has reached the highest point, and thereafter the filling of the second tank container or containers with liquid from the first tank container continues automatically through the liquid line exploiting hydrostatic forces, namely as long as the line opening of the liquid-line end protruding into the second tank container (additional tank) lies below the liquid level of the first tank container (main tank). This second possibility is not restricted to the employment of a tank sack as the first tank container, but can also be used, if certain basic conditions are heeded which are to be explained hereinafter, when e.g. the spreading material container itself is utilized as the first tank container (main tank).

Preferably, the (first) line opening of the liquid line lies near the bottom of the first tank container, in order for the first tank container to empty as completely as possible upon emptying. For the same reason, the (second) line opening of the liquid-line end attached to the second tank container (additional tank) or protruding thereinto lies at a place below the (first) line opening of the opposing liquid-line end attached to the first tank container (main tank) or protruding thereinto, in order for the first tank container to empty as deeply as possible upon emptying of the liquid tank. Hence, the (second) line opening preferably lies below the bottom of the first tank container.

The liquid line can be guided over an upper edge of the spreading material container. The highest point of the liquid line then lies above the spreading material container or a tank sack received therein. On the one hand, this offers the advantage that the maximum filling volume of the first tank container (spreading material container or tank sack received therein) can be completely filled with liquid without any problems before the filling of the second tank container through the liquid line begins. However, it is problematic that in this case, upon the employment of a tank sack as the first tank container, an excess pressure must be built up in the tank sack in order to urge the liquid out of the tank sack through the liquid line beyond the highest point of the liquid line. It is also important here that the liquid is pumped into the first tank container at a volume flow rate such that the liquid not only spills over the highest point, but fills the liquid line completely. For it is only with a closed liquid column in the liquid line that one achieves the goal of the liquid being dragged from the first tank container into the second tank container automatically due to hydrostatic forces.

When, in contrast, the first tank container is not formed by a tank sack but e.g. by the spreading material container itself, the production of an excess pressure in the first tank container is not possible. In this case there can for example be provided a suction pump on the liquid line, with which the liquid is sucked beyond the highest point of the liquid line once. Subsequently, the suction pump can be switched off and the further filling operation takes place automatically solely due to hydrostatic forces.

The excess pressure problem can be avoided when the liquid line is guided, not around the upper edge of the spreading material container, but in an upper region through the walling of the spreading material container. Then the filling of the second tank container begins when the first tank container is almost completely filled, and continues automatically provided it is ensured that a closed liquid column forms in the liquid line at the start of the independent filling operation, as previously explained.

In the upper region of the spreading material container the walling of the spreading material container is relatively well accessible even in the presence of a tank sack, so that the liquid line can be readily guided to the tank sack through the walling of the spreading material container at this place, or the tank sack can be attached at the corresponding place to an opening in the spreading material container, on the opposing side of which a hose leading to the additional tank is then attached.

The filling of the first tank container can be ended as soon as the second tank container automatically fills due to the acting hydrostatic forces. The first tank container then empties to the extent that the second tank container fills. Hence, it is preferred to fill the first tank container further while the second tank container is automatically filling with liquid from the first tank container until both tank containers are completely filled.

When, in the later operation of the spreader, one empties the liquid tank by liquid being diverted from the second tank containers (additional tanks), the liquid level in the first liquid tank (main tank, that is, spreading material container or tank sack) first sinks until its liquid level has sunk to the height of the highest second tank container (additional tank). Subsequently, the liquid levels in the two tank containers sink to the same extent until the (first) line opening in the first tank container protrudes over the liquid level. At this moment the liquid column in the liquid line breaks. When the diameter of the liquid line is small and the capillary forces sufficiently great, the liquid column located in the liquid line is dragged upon the further emptying of the second tank container. This effect is familiar to everyone in connection with drinking straws. Hence, it can be expedient to form the liquid line from a bundle of lines with a sufficiently small cross section in order to promote this effect.

Preferably, vent openings are provided on the first and second tank containers, so that the air located therein can escape to the extent that the corresponding tank container fills with liquid. Furthermore, a fill level limiter can be provided in the second tank container or in the first tank container, depending on the selected filling principle, which sends a stop signal to the filling apparatus when a specified fill level is reached.

Figure 1:
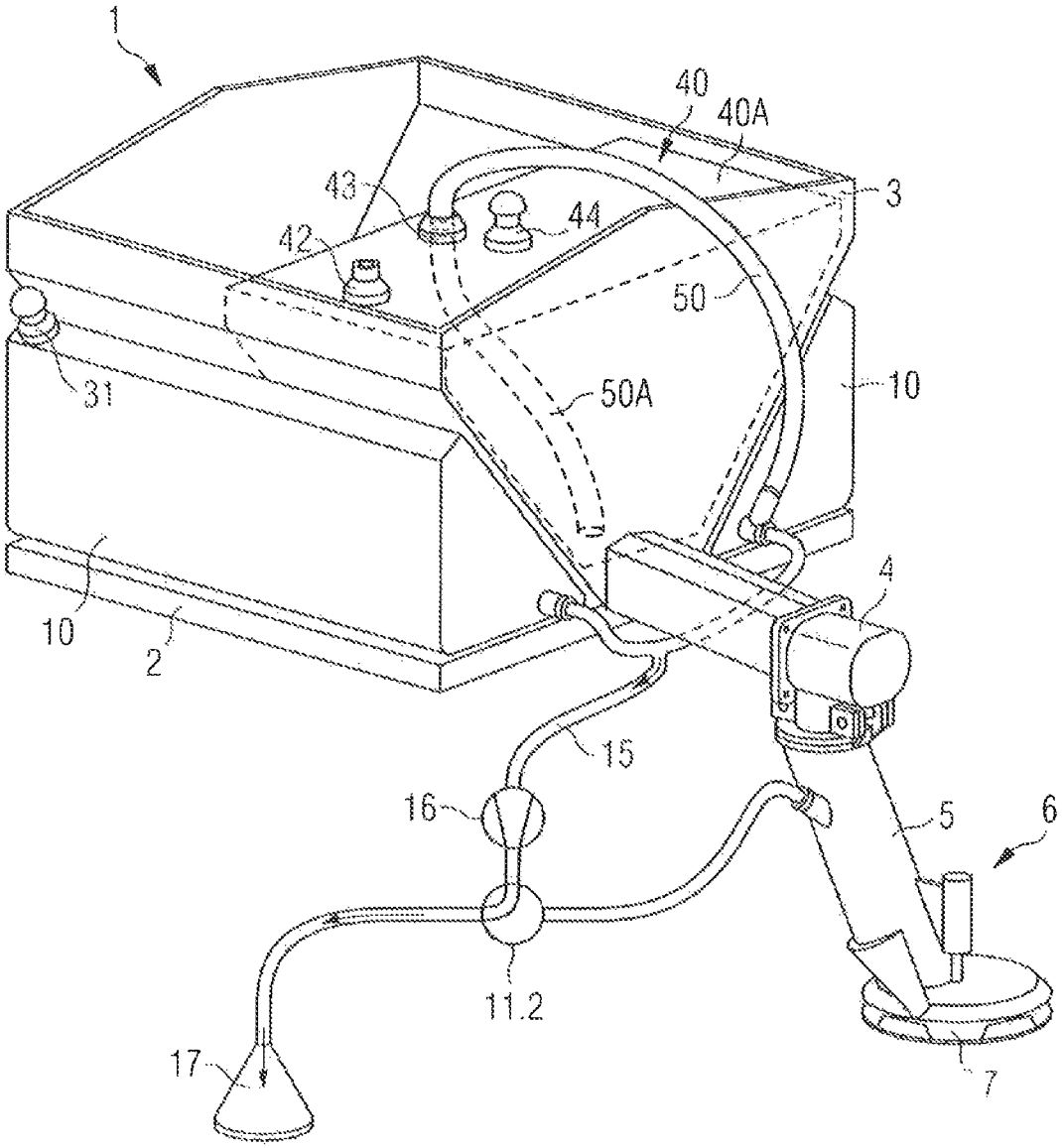
Figure 10:
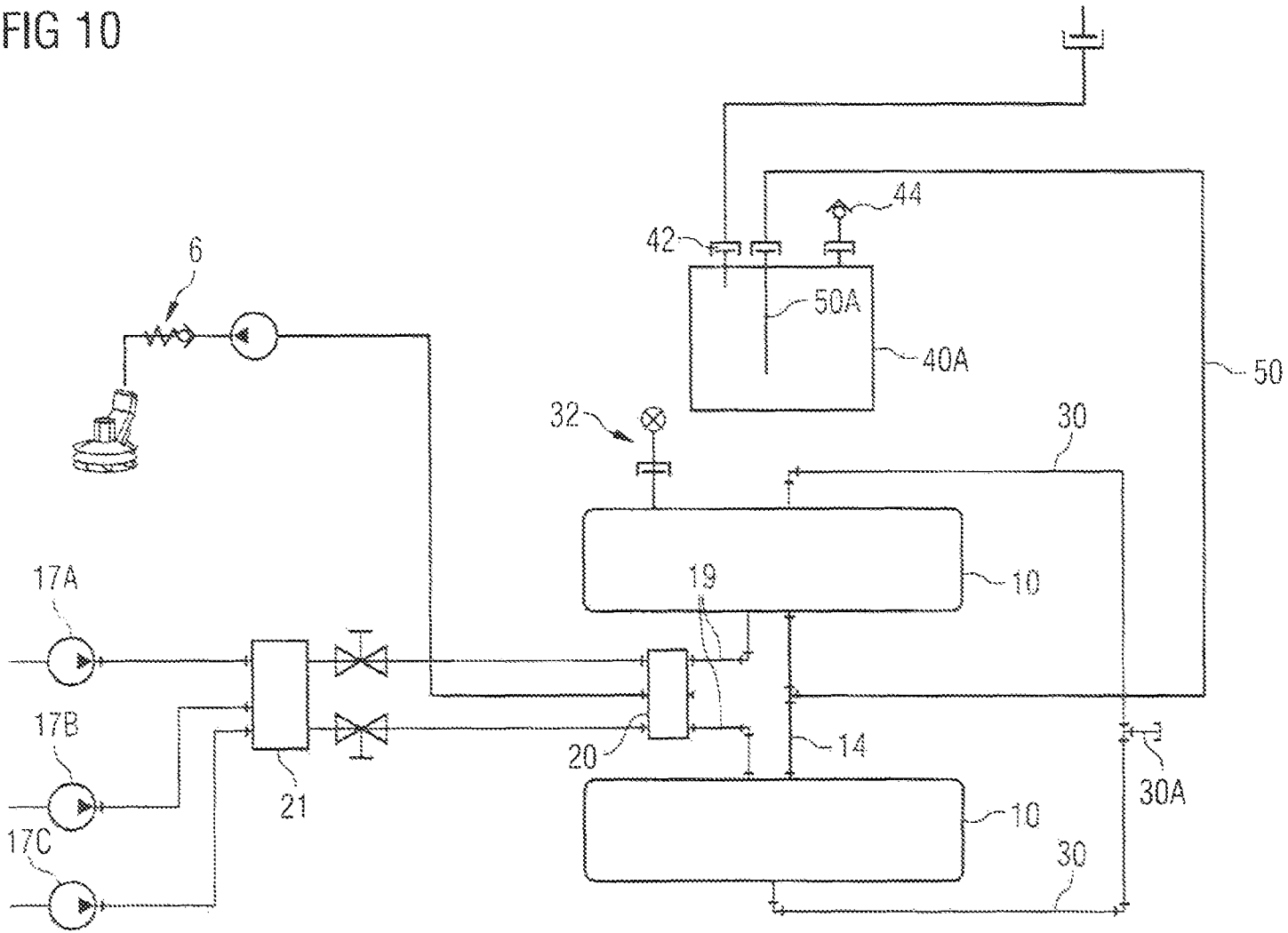
Figure 11:
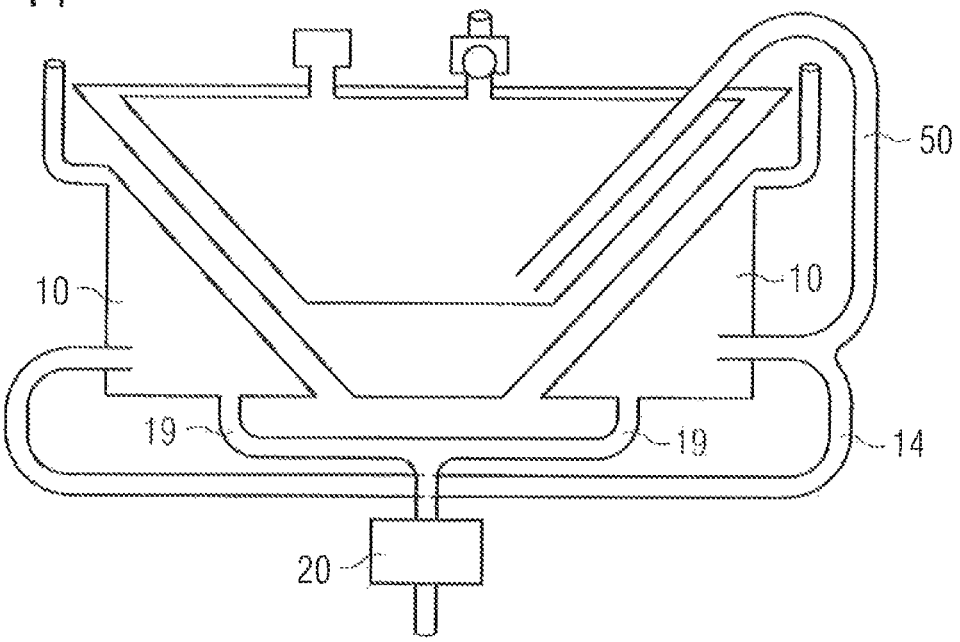
Figure 12:
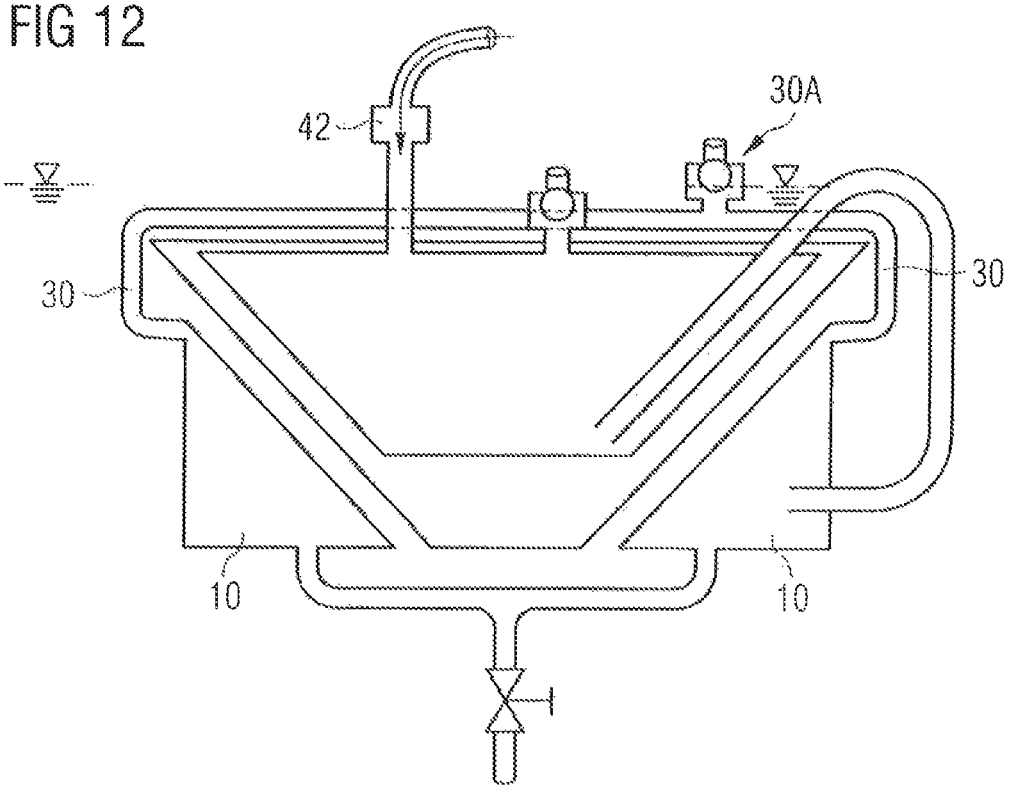
Figure 13:
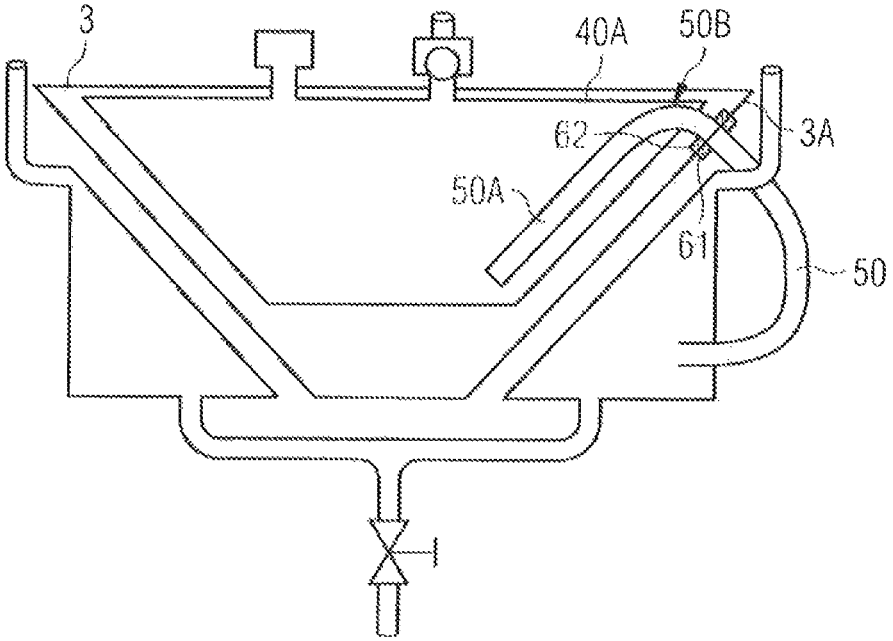
Figure 14:
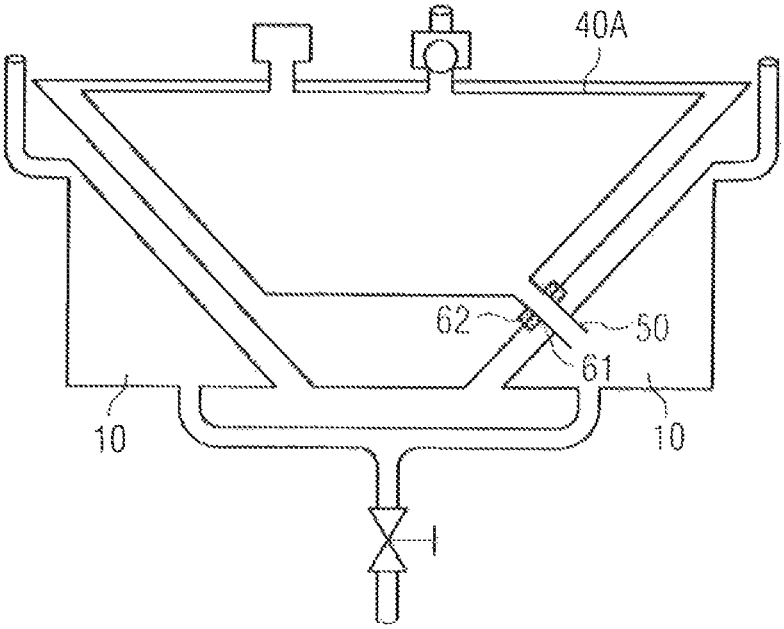
Figure 15:
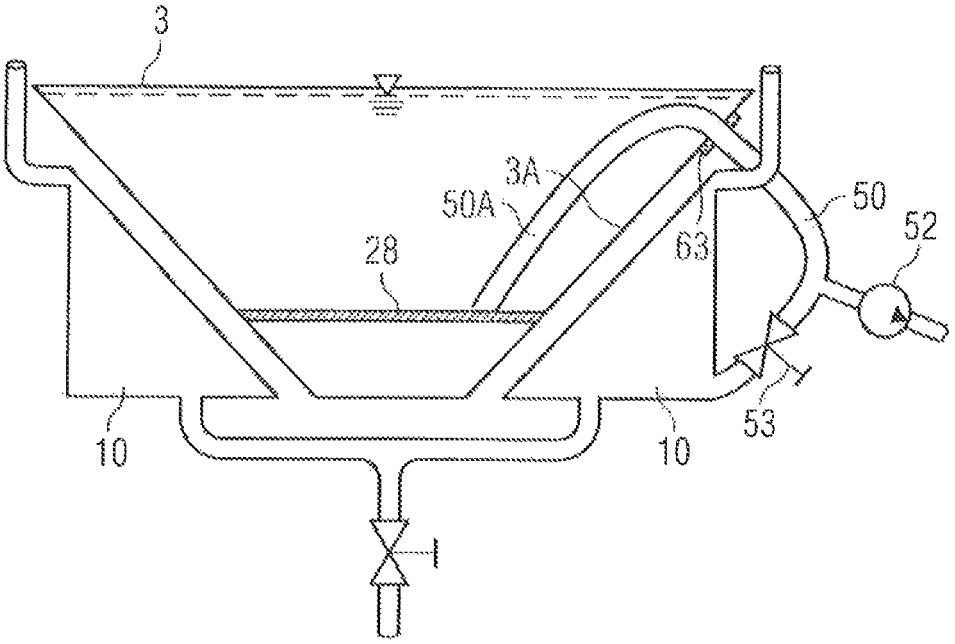
Figure 16:
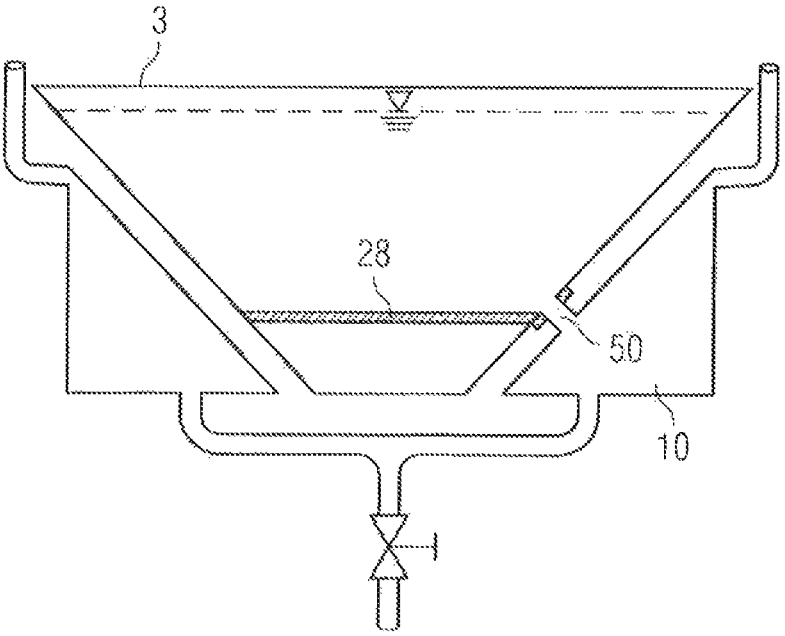

Hereinafter the invention will be described by way of example with reference to the accompanying drawings. Therein are shown:

FIG. 1 an isolated spreader according to a first exemplary embodiment in a perspective view, FIGS. 2 to 9 different states upon filling and emptying of the liquid tank of the spreader represented in FIG. 1, in a schematic cross section, FIG. 10 an equivalent diagram for the spreader according to FIGS. 1 to 9, FIG. 11 a schematic cross section through a spreader according to a second exemplary embodiment, FIG. 12 a schematic cross section through a spreader according to a third exemplary embodiment, FIG. 13 a schematic cross section through a spreader according to a fourth exemplary embodiment, FIG. 14 a schematic cross section through a spreader according to a fifth exemplary embodiment, FIG. 15 a schematic cross section through a spreader according to a sixth exemplary embodiment, FIG. 16 a schematic cross section through a spreader according to a seventh exemplary embodiment, FIG. 17 a spreader according to the prior art having a tank sack received in the spreading material container, and FIG. 18 the spreader according to the prior art from FIG. 17 without a tank sack.

Represented in FIG. 1 is an attachable spreader 1 as a superstructure on a loading surface of a truck, which is not represented explicitly here. On a welded support frame 2 there is constructed a spreading material container 3 which possesses a funnel-shaped cross section, so that thawing materials received in the spreading material container collect at the tapered bottom of the spreading material container 3. A screw conveyor at the bottom of the spreading material container transports solid spreading materials, in particular spreading salt, out of the spreading material container 3 to an outlet 4, through which the spreading materials can in turn fall due to gravity into the downpipe 5 of a spreading device 6 and through the downpipe 5 onto a spreading disk 7 of the spreading device 6. Two additional tanks 10 for liquid, in particular for a salt solution (brine), are provided in order to admix liquid in a suitably metered quantity to the dry spreading materials falling through the downpipe 5. This is effected in a per se known manner via a suction line 15 while employing an accordingly actuated pump 16. The place of admixture need not necessarily be in the downpipe itself, but may for example also be only at the lower end of the downpipe 5 on the spreading disk 7.

Further additional tanks 10 can be provided for example before the spreading material container 3. In particular, the additional tanks 10 can be of considerably smaller size than represented in FIG. 1, so as to allow the content of the spreading material container 3 to be enlarged. If a plurality of additional tanks 10 for admixing liquid thawing materials are provided, they are preferably interconnected via lines.

The functions of pure brine spreading, dry salt spreading and wet salt spreading can be obtained with the pump 16 and suitable valves 11.2. By means of the valve 11.2 configured as a three-way cock (for example ball cock), the pump 16 can be connected to the spraying device 17 or to the downpipe 5 in order to switch over between pure brine spreading and wet salt spreading. If dry salt is to be spread, i.e. without the admixture of brine from the additional tanks 10, either the pump 16 can be switched off or the three-way cock 11.2 be so swiveled that the route from the pump 16 both to the spraying device 17 and to the spreading device 6 is interrupted. On the other hand, it is also possible with the position of the three-way cock 11.2 represented in FIG. 1 to spread both dry salt by means of the spreading device 6 and pure brine by means of the spraying device 17. Through suitable modification of the system, for example through different or additional way valves and/or additional lines and/or line branches and/or through one or more further pumps, it can also be guaranteed that simultaneously pure brine is spread via the spraying device 17 and wet salt via the spreading device 6.

To now increase the brine receiving capacity of the spreader 1, a liquid tank 40 is inserted in the spreading material container 3 and connected to the additional tanks 10 via a liquid line 50. The liquid tank 40 can be filled with brine via a filling port 42.

In addition to the filling port 42 there is provided a feed-through port 43 through which the liquid line 50 is guided into the liquid tank 40 with a hose extension 50A. The hose extension 50A reaches down to the bottom of the liquid tank 40. Thus, the liquid tank 40 can be completely emptied through the liquid line 50 and the liquid be supplied to the additional tanks 10, that is, in the concrete exemplary embodiment according to FIG. 1 to the suction line 15 connecting the two additional tanks 10.

In the exemplary embodiment according to FIG. 1, the liquid tank 40 is formed by a tank sack 40A which is inserted into the spreading material container 3, as described. For the purposes of the present invention, the tank sack 40A need not necessarily consist of a flexible, foldable material, it can equally well be configured as a rigid insertable tank. However, it is preferred when the tank sack is flexible and foldable, as described in DE 10 2010 029 142 A1, so that it is better storable.

The tank sack 40A fills only half of the spreading material container 3. In the remaining other half there can be received a second tank sack 40A or else dry spreading material which is then conveyed through below the tank sack 40A to the spreading device 6. If a second tank sack 40A is provided, an overflow between the tank sacks can be provided which, for easier operability, is disposed as far upward as possible. The overflow of the second tank sack then in turn has a hose extension attached thereto which reaches to the bottom of the second tank sack.

With reference to FIGS. 2 to 9 the principle of filling and emptying the liquid tank will hereinafter be described, said tank being composed here of the first tank container formed by the tank sack 40A, and by two additional tanks 10 as second tank containers. The representations are to be understood as purely schematic.

Figure 2:
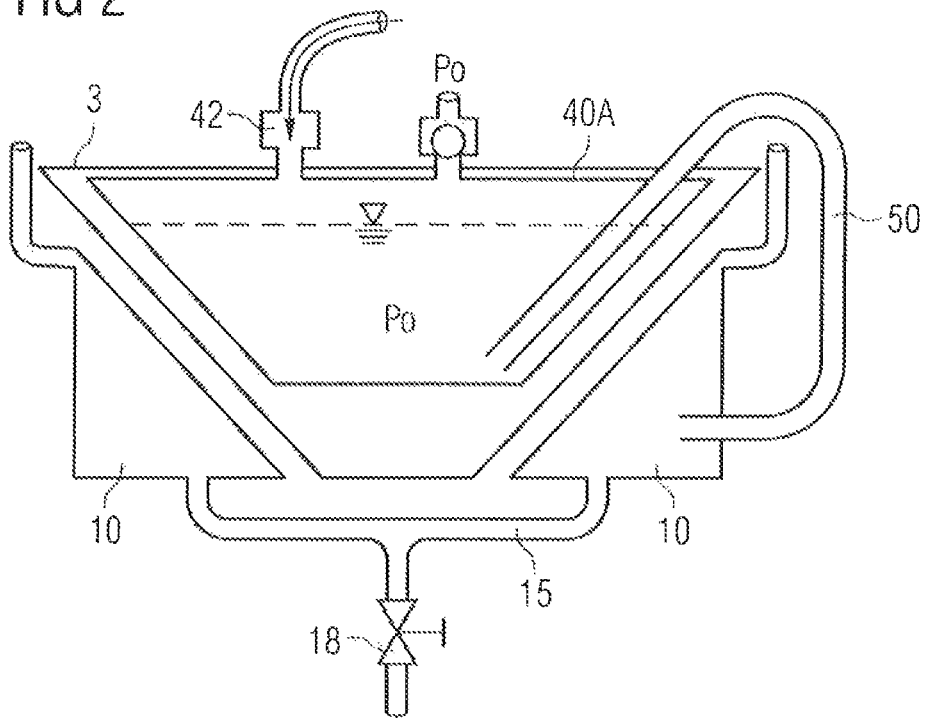

FIG. 2 shows a first phase of the filling operation of the tank container 40A. At this moment the additional tanks 10 are still completely empty. The blocking valve 18 is closed. Instead of the blocking valve 18, the closing of the suction line 15 attached to the two additional tanks 10 can also be ensured solely by the pump 16 (FIG. 1). According to the liquid level represented in FIG. 2, the tank sack 40A is not yet completely filled. The pressure acting on the liquid corresponds to the ambient pressure $p_0$. The arrow indicates that the tank sack 40A is being filled with liquid further through the filling port 42.

Figure 3:
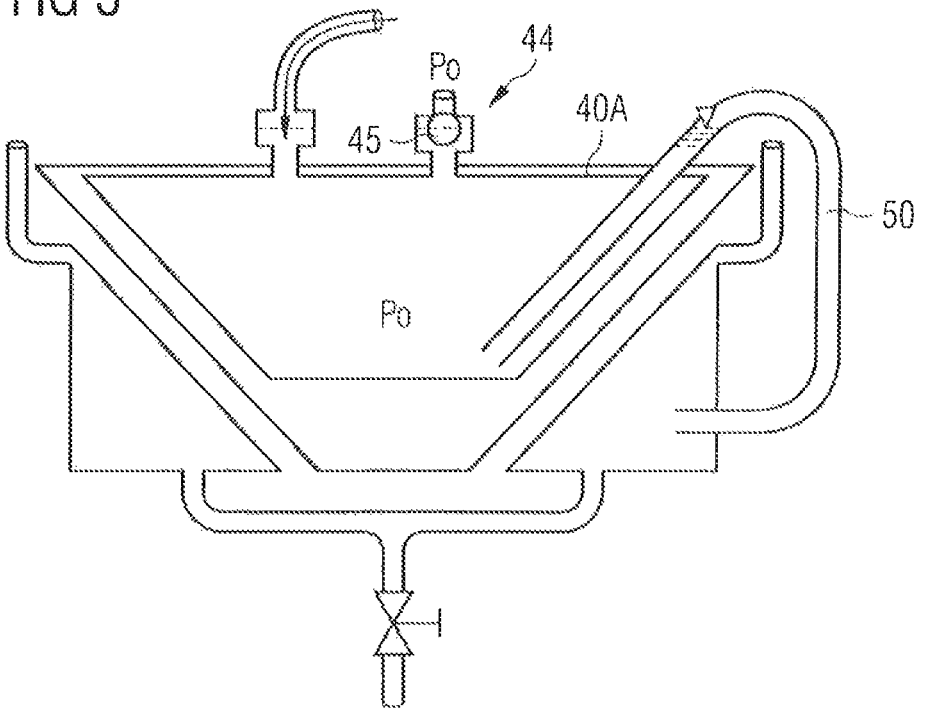

In FIG. 3 the liquid level has risen so far that the vent valve 44 (cf. also FIG. 1) closes. A float 45 in the vent valve 44 ensures that no liquid can exit from the tank sack 40A. The pressure acting on the liquid in the tank sack 40A still corresponds at this time to the ambient pressure $p_0$. The liquid level has already risen in the liquid line 50 over the tank sack 40A.

Figure 4:
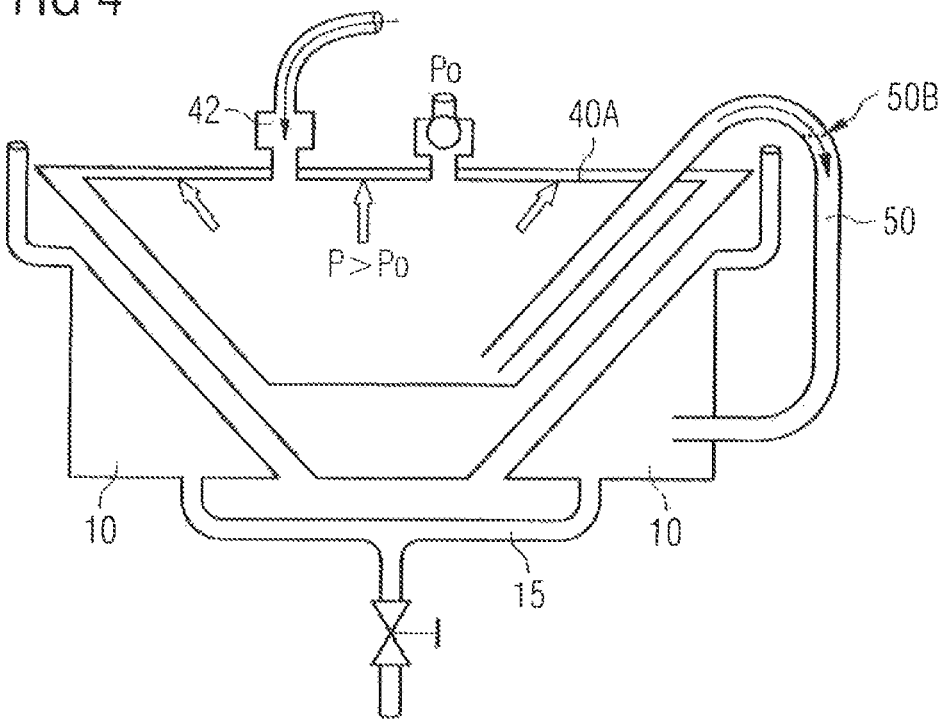

Upon further filling of the tank sack 40A (FIG. 4) the pressure p acting on the liquid located in the tank sack 40A is increased above the ambient pressure $p_0$. The tank sack 40A blows up (not shown), as indicated by the arrows represented in the tank sack, and the liquid located in the tank sack 40A is urged through the liquid line 50 out over the highest point 50B of the liquid line 50. This moment is represented in FIG. 4. The volume flow rate through the filling port 42 is sufficiently great for the liquid to not only spill over the highest point 50B of the liquid line 50, but to completely fill and flow down the liquid line 50 as a closed liquid column.

Figure 5:
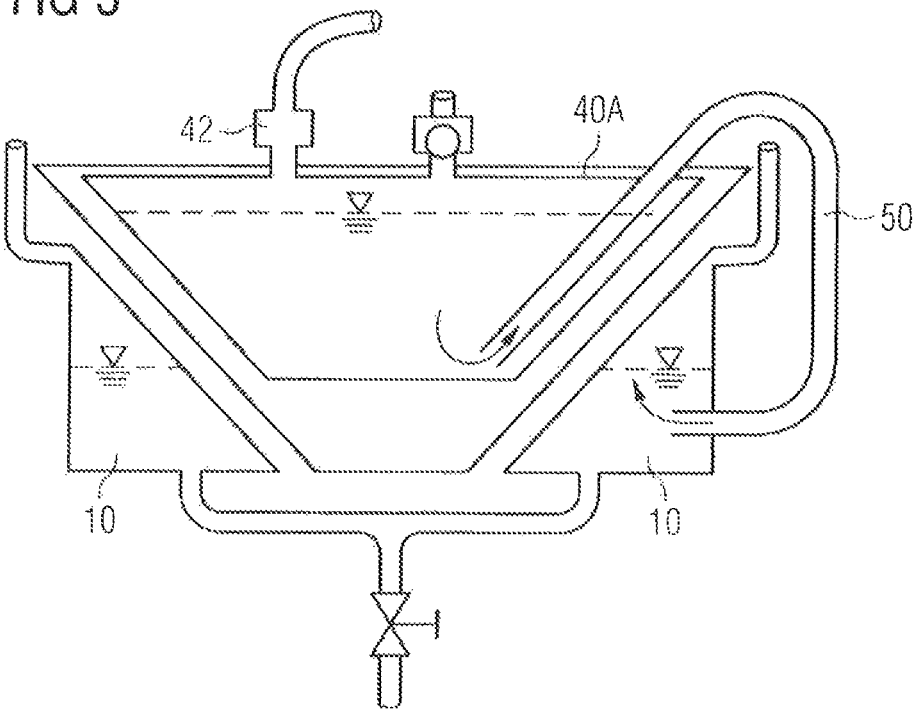

As soon as the liquid column has fallen below the lowest point of the tank sack 40A, liquid from the tank sack 40A automatically flows through the liquid line 50 into the right-hand additional tank 10 and via the connecting line 15 also into the left-hand additional tank 10. FIG. 5 illustrates this principle. The liquid level in the additional tanks 10 rises in parallel fashion to the extent that the liquid level in the tank sack 40 sinks. It is not necessary at this moment to feed more liquid through the filling port 42 (but this is advisable in order to keep the total filling time as short as possible).

Figure 6:
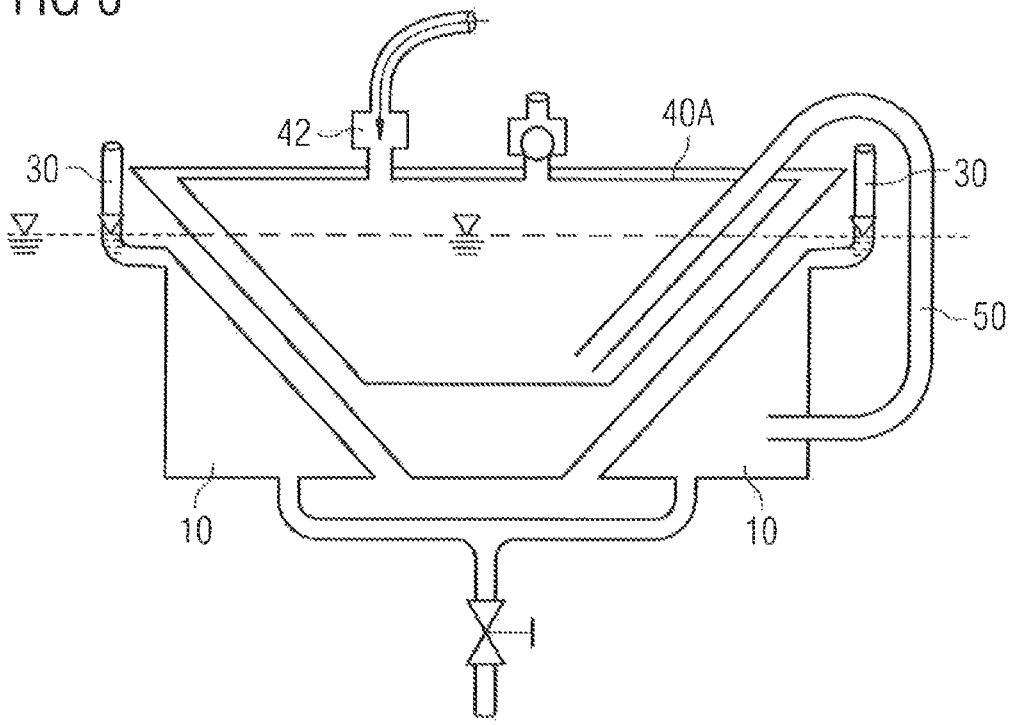
Figure 7:
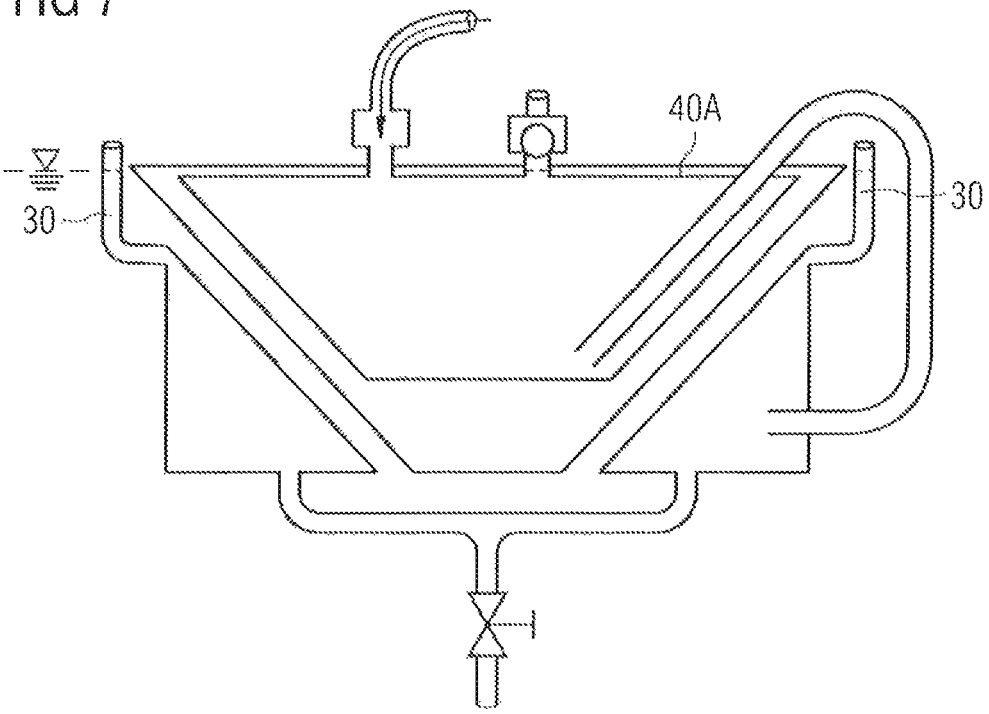

FIG. 6 shows the state in which the liquid levels in all tank containers 40A and 10 have reached the same level. There is no further liquid flowing through the liquid line 50. The liquid level of the additional tanks 10 has risen into the upward leading vent pipes 30. Now, at the latest, the filling operation is continued by further feeding of liquid through the filling port 42 into the tank sack 40A. The liquid level in the vent pipes 30 rises further until the maximum filling volume is reached, as represented in FIG. 7. Accordingly, the vent pipes 30 end above the highest filling level of the tank sack 40A.

Figure 8:
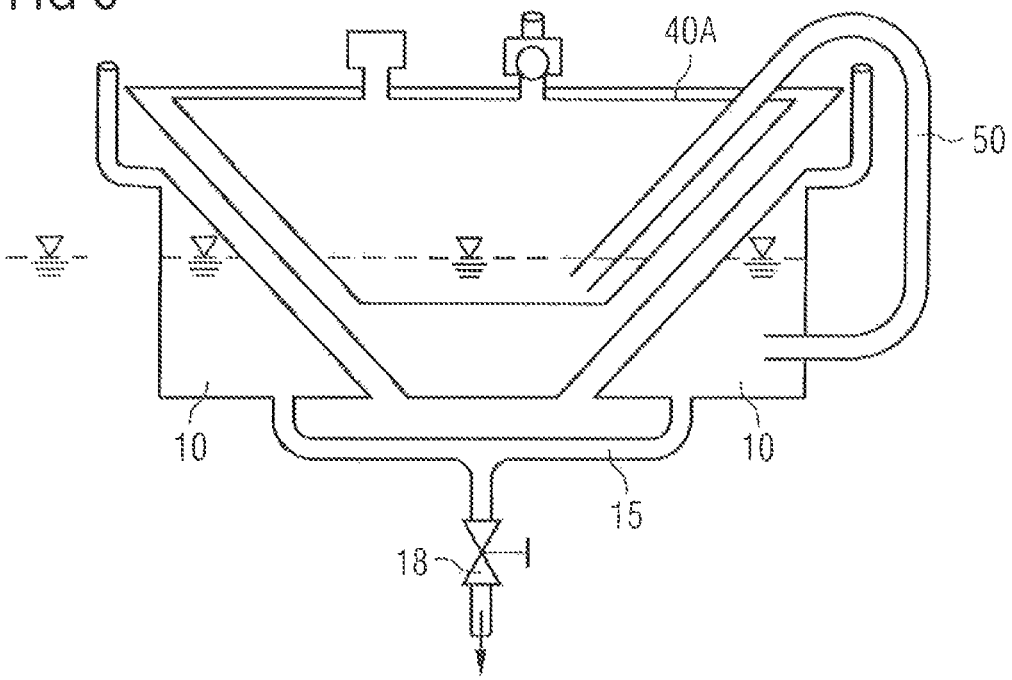
Figure 9:
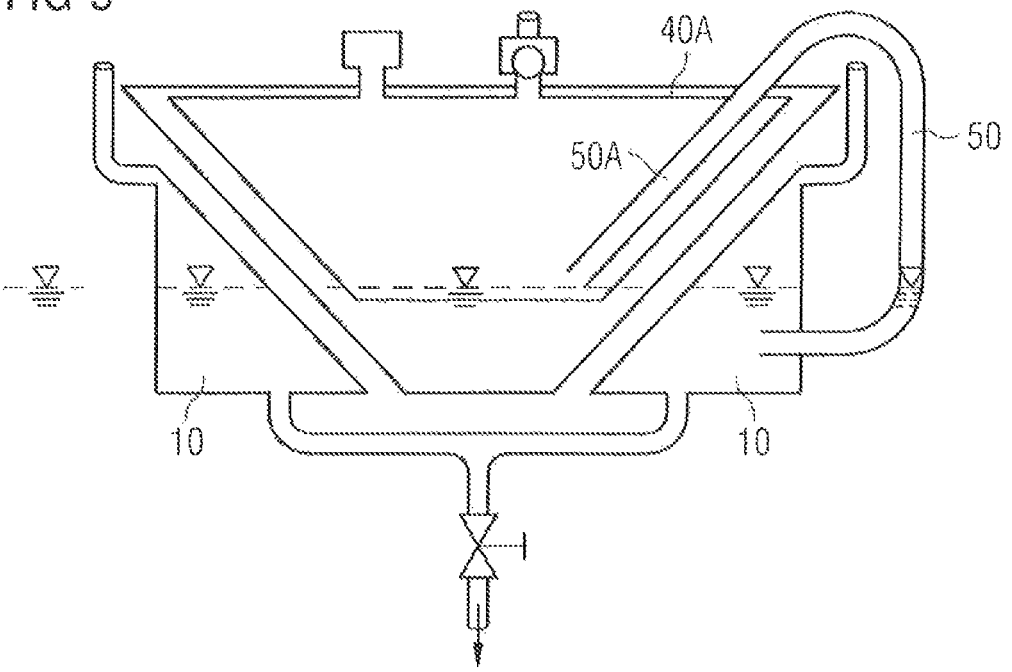

For emptying the liquid tank, the blocking valve 18 is opened or the pump 16 operated accordingly. Liquid is then removed from the additional tanks 10 through the suction line 15 and, to the same extent, liquid flows from the tank sack 40A into the additional tanks 10 through the liquid line 50, as represented in FIG. 8. The liquid level sinks uniformly in all tank containers 40A and 10 until it has reached the lowermost level, shown in FIG. 9, at which the line opening of the hose extension 50A protruding in the tank sack 40A emerges from the liquid level. From this moment on, the further emptying of the liquid tank is effected solely out of the additional tanks 10.

Instead of the vent pipes 30, the additional tanks 10 can also be equipped with vent valves 31, as represented in FIG. 1. This vent valve 31, similarly to the vent valve 44 of the tank sack 40A, closes automatically when an accordingly high fill level is reached. This moment can be captured by measuring technology and serve as a signal for adjusting the further filling of the tank sack 40A, this only being expedient, however, when the filling of the tank sack 40A is continued while the additional tanks 10 are filling with liquid passed from the tank sack 40A through the liquid line 50.

FIG. 10 shows an equivalent circuit diagram for the spreader represented in FIG. 1. Via a filling port 42, liquid is passed into the tank sack 40A. The tank sack 40A vents via the vent valve 44 and the liquid is fed via the liquid line 50 and hose extension 50A to the connecting line 14 between the two additional tanks 10 via which the liquid then flows into the additional tanks 10. The two additional tanks 10 are attached via vent pipes 30 to a common vent 30A which ends above the additional tank 40A (not represented in the equivalent diagram). A separate fill level limiter 32 is attached to one of the two additional tanks 10 and signals the end of the filling operation at a specified fill level.

Via lines 19 the additional tanks 10 are coupled to a distributor 20 which feeds the liquid out of the additional tanks 10 electively to the spreading device 6 or to a further distributor 21 with which the liquid can be allocated to a plurality of spray heads 17A, 17B, 17C.

FIG. 10 thus simultaneously represents a second exemplary embodiment as a deviation from the first exemplary embodiment, which is schematically rendered again in FIG. 11. Accordingly, the liquid line 50 leads here into a connecting line 14 between the two additional tanks 10, which is different from the suction lines 19 leading to the distributor 20, via which liquid is removed from the additional tanks 10.

FIG. 12 shows as a third exemplary embodiment a further modification which was likewise already explained in connection with the equivalent diagram according to FIG. 10. Accordingly, the vent pipes 30 of the additional tank 10 end in a common vent 30A, which is in turn configured as a self-closing valve which closes when the liquid level in the total liquid tank has reached the vent 30A. This can, as mentioned, be captured by measuring technology and serve as a signal for switching off the filling operation. Accordingly, in this third exemplary embodiment the filling port 42 lies above the vent 30A in order that the filling port 42 can be closed safely without liquid exiting from the liquid tank.

FIG. 13 shows as a further modification a fourth exemplary embodiment. Here the uppermost point 50B of the liquid line 50 lies in an upper region of the tank sack 40A directly below the maximum filling height of the tank sack 40A. The liquid hence flows out of the tank sack 40A into the liquid line 50 when the maximum fill level in the tank sack 40A is approximately reached, without an excess pressure having to be produced in the tank sack 40A. The liquid line 50 then leads further in the upper region of the spreading material container 3 through a walling 3A of the spreading material container 3. Couplings 61 and 62 on the container wall 3A are provided in order to attach thereto the liquid line 50 from the outside and the hose extension 50A from the inside. This is also relatively unproblematic on the inner side of the spreading material container 3, because this place on the spreading material container 3 is readily accessible even in the presence of the tank sack 40A.

FIG. 14 shows as a further modification a fifth exemplary embodiment in which the liquid line 50 starts in a lower region of the tank sack 40A, namely at the bottom of the tank sack 40A, and leading constantly downward is attached to one of the two additional tanks 10. A horizontal arrangement of the liquid line 50 would also be possible. Here, too, the couplings 61 and 62 are again provided in the walling 3A of the spreading material container 3 in order to attach thereto on the inside the connection to the tank sack 40A and on the outer side the connection to the additional tank 10.

FIG. 15 shows as a further modification a sixth exemplary embodiment. In this case, the first tank container (main tank) is formed, not by a tank sack inserted into the spreading material container, but by the spreading material container 3 itself. A plate 28 inserted sealingly into the spreading material container 3 forms the bottom of the first tank container. Therebelow there extends the conveying device for conveying solid spreading materials in case the spreading container 3 at other times does not serve as a liquid tank, but in the conventional manner as a container for receiving spreading salt for example. The liquid line 50 is guided into the spreading material container 3 via an aperture 63 in the walling 3A of the spreading material container 3 and protrudes with its hose extension 50A down to the bottom of the spreading material container 3. The filling and emptying principle corresponds to the previously described principle, being in particular similar to the fourth exemplary embodiment according to FIG. 13. If the liquid pressure upon filling the tank containers does not suffice to produce a closed water column in the liquid line 50 in order to guarantee thereafter an independent flow of liquid out of the spreading material container 3 into the additional tank 10, there can additionally be provided e.g. a suction pump 52 and a blocking valve 53. First, the blocking valve 53 is closed and subsequently the suction pump 52 put into operation. As soon as the suction pump 52 has sucked in liquid, the suction pump 52 can be switched off and subsequently the blocking valve 53 opened. Then the liquid flows through the liquid line 50 automatically from the spreading material container 3 into the additional tank 10. Other possibilities for setting off a flow through the liquid line 50 are likewise possible.

FIG. 16 finally shows as a further modification a seventh exemplary embodiment. As already in the sixth exemplary embodiment, the spreading material container 3 itself serves here as the first tank container (main tank) for receiving the brine and, similarly to the fifth exemplary embodiment, the connecting line 50 leads here from a lower region of the spreading material container 3 constantly downward or alternatively horizontally into the additional container 10.

Instead of the spreading material container 3, another tank can also serve as the main tank or "first tank". The previously described principles, in particular the employment of a connecting line 50 passing through a highest point, are applicable thereto in the same way.

The invention claimed is:

1. A method for filling a liquid tank of a spreader for winter service vehicles, wherein the liquid tank has a first tank container and at least one second tank container connected to the first tank container via a liquid line, and wherein the first tank container is a spreading material container which is adapted for holding solid spreading material and is coupled or coupleable to a spreading device for spreading the solid spreading materials received in the spreading material container, or a tank sack or rigid insertable tank received in the spreading material container, characterized by the following steps:

filling the first tank container with liquid, up to a moment as of when the liquid filled in the first tank container begins to flow through the liquid line into the at least one second tank container, and filling the at least one second tank container with liquid from the first tank container through the liquid line following the above-mentioned moment, or filling the at least one second tank container with liquid, up to a moment as of when the liquid filled in the at least one second tank container begins to flow through the liquid line into the first tank container, and filling the first tank container with liquid from the at least one second tank container through the liquid line following the above-mentioned moment.

2. The method according to claim 1, wherein the liquid line possesses a highest point and the step of filling the at least one second tank container only begins and is continued exploiting hydrostatic forces after the liquid in the liquid line has reached the highest point.

3. The method according to claim 2, wherein the highest point of the liquid line lies at the height of an upper region of the first tank container or thereabove, so that the step of filling the at least one second tank container only begins when the first tank container is completely or at least almost completely filled.

4. The method according to claim 3, wherein a maximum filling volume of the first tank container is completely filled with liquid before the filling of the at least one second tank container begins.

5. The method according to claim 1, wherein the filling of the first tank container is continued during the filling of the second tank container.

6. A method for emptying a liquid tank of a spreader for winter service vehicles, wherein the liquid tank has a first tank container and at least one second tank container connected to the first tank container via a liquid line, a first line opening of the liquid line lies in the first tank container, and the first tank container is a spreading material container which is adapted for holding solid spreading material and is coupled or coupleable to a spreading device for spreading the solid spreading materials received in the spreading material container, or a tank sack or rigid insertable tank received in the spreading material container, characterized by the following steps:

removing liquid from the first tank container through the second tank container by a second line opening of the liquid line being so disposed that upon removal of the liquid from the second tank container liquid from the first tank container flows into the second tank container solely due to hydrostatic forces, or removing liquid from the second tank container through the first tank container by a second line opening of the liquid line being so disposed that upon removal of the liquid from the first tank container liquid from the second tank container flows into the first tank container solely due to hydrostatic forces.

7. The method according to claim 6, wherein the liquid line is so disposed that a highest point of the liquid line lies between the first line opening of the liquid line and the second line opening of the liquid line.

8. The method according to claim 7, wherein the highest point of the liquid line lies at the height of an upper region of the first tank container or thereabove.

9. A spreader for winter service vehicles having a spreading device and a liquid tank, said liquid tank comprising at least one first tank container and at least one second tank container connected to the first tank container via a liquid line, wherein the first tank container is a tank sack or rigid insertable and removable tank received in a spreading material container which is adapted for holding solid spreading material and is coupled to the spreading device so as to allow for spreading the solid spreading materials received in the spreading material container via the spreading device, and wherein the liquid line is attached at a first end to the first tank container or protrudes thereinto and possesses there a first line opening, and is attached at a second end to the at least second tank container or protrudes thereinto and possesses there a second line opening, wherein the liquid line is arranged to transport liquid from the first tank container through the liquid line into the second tank container, or vice versa, without any device for actively conveying the liquid and solely due to hydrostatic forces.

10. The spreader according to claim 9, wherein the liquid line possesses a highest point between the first line opening and the second line opening, which lies at the height of an upper region of the first tank container or thereabove.

11. The spreader according to claim 9, wherein the liquid line leads constantly downward or horizontally between the first line opening and the second line opening.

12. The spreader according to claim 11, wherein the liquid line leads through a walling of the spreading material container.

13. The spreader according to claim 9, wherein the first tank container has a first vent opening which is arranged so that air can escape through the first vent opening while the first tank container is being filled with liquid through an opening different from the first vent opening.

14. The spreader according to claim 9, wherein the at least one second tank container has at least a second vent opening which is arranged so that air can escape through the second vent opening while the at least one second tank container is being filled with liquid through an opening different from the second vent opening.

15. A winter service vehicle comprising a spreader, the spreader having a spreading device and a liquid tank, said liquid tank comprising at least one first tank container and at least one second tank container connected to the first tank container via a liquid line, wherein the first tank container is a tank sack or rigid insertable and removable tank received in a spreading material container which is adapted for holding solid spreading material and is coupled to the spreading device so as to allow for spreading the solid spreading materials received in the spreading material container via the spreading device, and wherein the liquid line is attached at a first end to the first tank container or protrudes thereinto and possesses there a first line opening and is attached at a second end to the at least second tank container or protrudes thereinto and possesses there a second line opening, wherein the liquid line is arranged to transport liquid from the first tank container through the liquid line into the second tank container, or vice versa, without any device for actively conveying the liquid and solely due to hydrostatic forces.

* * * * *